United States Patent [19]

Randisi

[11] Patent Number: 5,050,959

[45] Date of Patent: Sep. 24, 1991

[54] FIBER OPTIC COMPOSITIONS AND METHOD FOR MAKING THEREOF

[76] Inventor: Sal Randisi, 24 Davinci Dr., Bohemia, N.Y. 11761

[21] Appl. No.: 566,877

[22] Filed: Aug. 13, 1990

Related U.S. Application Data

[60] Continuation of Ser. No. 361,300, Jun. 5, 1989, abandoned, and a continuation-in-part of Ser. No. 768,060, Aug. 22, 1985, abandoned, which is a division of Ser. No. 677,888, Dec. 3, 1984, abandoned, which is a continuation of Ser. No. 649,050, Sep. 10, 1984, abandoned.

[51] Int. Cl.[5] ..... G02B 6/44; C10M 107/08

[52] U.S. Cl. ..... 385/100; 252/28; 252/30; 358/901

[58] Field of Search ..... 252/28, 30; 350/96.23; 358/901; 585/10

[56] References Cited

U.S. PATENT DOCUMENTS

| | | | |
|---|---|---|---|
| 4,062,784 | 12/1977 | Baur | 252/59 |
| 4,075,113 | 2/1978 | Van Doorne | 252/49.5 |
| 4,396,514 | 8/1983 | Randisi | 252/30 |
| 4,810,395 | 3/1989 | Levy et al. | 252/28 |

*Primary Examiner*—Jacqueline V. Howard

*Attorney, Agent, or Firm*—Stephen E. Feldman

[57] ABSTRACT

Lubricating compositions for use with fiber optic elements and method for their preparation are claimed. Lubricating compositions are made from a mixture of polybutene and hydrophobic silica. The other ingredients such as oily polybutene, an amine phosphate, mineral oil, polytetrafluoroethylene, polyethylene are optional. Other materials such as coloring agents and antioxidants can be also used.

10 Claims, No Drawings

FIBER OPTIC COMPOSITIONS AND METHOD FOR MAKING THEREOF

RELATED APPLICATION

This application is a continuation-in-part of co-pending application by the same inventor, Optical Wave Compounds, Ser. No. 06/768,060 filed Aug. 22, 1985, which was a division of Ser. No. 06/677,888 filed Dec. 3, 1984, which was a continuation of Ser. No. 06/649,050 filed Sept. 10, 1984, all of which have now been abandoned. Related applications by the present inventor, Ser. No. 490,502 filed Feb. 28, 1990 and Ser. No. 479,188 filed Feb. 13, 1990 have been expressly abandoned in favor of the present application.

This application is a continuation of application Ser. No. 07/361,300, filed 6/5/89 abandoned.

FIELD OF THE INVENTION

The invention relates to polymer-containing synthetic fiber optic lubricating compositions and a method for making such lubricants. The compositions are water and wheather resistant and operable over an extremely wide temperature range.

BACKGROUND OF THE INVENTION

Increasingly in modern day technology, especially in the technology employing beams of light for the transmission of data, or other communications, fiber optics are being employed. Since the fiber optic element, itself, is generally relatively fragile, in order to employ it, one or more such fiber optic elements are held together in a bundle and the bundle is inserted into a protective tube, such as a polyethylene jacket.

The fiber optic elements, however, cannot be merely allowed to remain loose in a jacket of the type referred to. If such were to be the case, then almost any kind of mechanical shock or bending could result in damage to or breakage of the fiber optic element. In view of the substantial length of many of these presently used fiber optic data transmission cables, replacement or repair of the fiber optic elements would be both difficult and expensive.

Accordingly, means must be provided for cushioning of the fiber optic elements within the jacket in which such elements are carried from one point to another.

In providing lubrication for or cushioning of the fiber optic elements which are carried in a jacket or sheath, care must be taken to assure that the optical qualities of the fiber optic elements are not diminished. Thus, in formulating a lubricant or cushioning agent for use with fiber optic elements carried in a sheath, the formulation must provide, not only, the necessary lubrication or cushioning, but must also not deleteriously affect the optical qualities of the element.

The known water and weather resistant petroleum based compositions combine various oils and additives to increase the lubricating quality and durability of the lubricant.

GB patent 1399350 to Foord et al describes water blocking composition consisting essentially of a liquid petroleum based oil with dispersion of a solid gellant. The gellant may be bentonite clay or sub-micron particle size silica. The composition is used as a water blocking composition for cables.

U.S. patent application Ser. No. 07/052121 filed May 18, 1987 and 06/768,060 filed Aug. 22, 1985 , both now abandoned to Randisi discloses a fiber optic lubricating composition for use with optical fiber elements. The composition includes as a major component a lubricating fluid such as a natural or synthetic hydrocarbon petroleum distillate, an oily, polybutene, a silicone dioxide thickener, such as a fumed silica. The composition may contain a polytetrafluoroethylene and various additives such as coloring agents.

While the known water resistant lubricating compositions posess some unique features they are expensive and not completely suitable for many potential applications.

It is therefore an object of this invention to provide an improved lubricating compositions which are water resistant and have wide service temperature range, high shear and oxidation stability, low toxity, and a novel method for making compositions.

SUMMARY OF THE INVENTION

In accordance with the present invention, an optical fiber composition which is both non-toxic and non-melting has been developed. The composition satisfies the various requirements for such a composition, including the provision of sufficient lubricity or cushioning for a fiber optic element, or series of such elements, placed within a jacket, minimal or no interference with the optical properties of the optical fiber elements so contained.

The compositions of the present invention, which will hereinafter be referred to as a fiber optic lubricating composition, comprises a stable dispersion of a base fluid such as polybutene and a gelling agent such as fumed hydrophobic silica. A polybutene has the following formula:

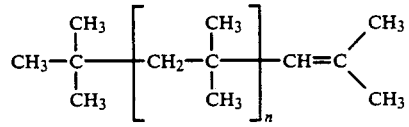

where n is from about 2 to about 40, said polybutene comprising from about 90% to about 99% by weight of said composition.

A fumed silica, silicon dioxide, is in the form of finely divided hydrophobic silica powder with particles ranging from about 12 to 16 millimicrons in size, said silicon dioxide comprising from about 2 to 10% of said composition. The composition may optionally contain a finely divided polymer fluorocarbon powder such as polytetrafluoroethylene, polyglycol such as polyethylene glycol, oily polybutene and additive such as amine phosphate.

The antioxidants, zeolites, butadiene styrene, mineral oil such as paraffinic mineral oil and stabilizers may be also included. An oily polybutene has the following formula:

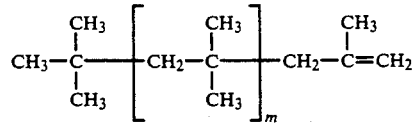

wherein n is from about 15 to about 35, said polybutene comprising from about 0% to about 10% by weight of said composition.

A method for preparation of fiber optic lubricating composition which comprises mixing a base fluid with fluid additives at a speed in a range from about 1200 to about 1600 rpm to achieve homogenised and uniformly distributed mixture; subjecting said mixture to a heat treatment at a temperature from 200° to 400° F. and at a speed from 500 to 1000 rpm to degas said mixture; admixing the thus heat-treated mixture with a gelling agent being taken in a range from about 1 to about 10 parts by weight under substantially high shear force sufficient to produce a homogeneous mixture.

DETAILED DESCRIPTION OF THE INVENTION

The invention is directed to a fiber optic lubricating compositions that comprises a stable dispersion of a basic fluid and hydrophobic fumed silica. The basic fluid is polybutene produced and sold by Amoco as polybutene grade L14. More specifically, the polybutenes are a series of isobutylene-butene copolymers composed predominantly of high molecular weight mono-olefins (95–100%) and isoparaffins. They are tacky, chemically stable, permanently-fluid liquids with moderate to high viscosity, colorless, resistant to oxidation by light and heat, completely hydrophobic, and unpermeable to water vapor and gases. The polybutenes are miscible at room temperature with all hydrocarbon solvents, with chlorohydrocarbons such as carbon tetrachloride, chloroform and trichlorethylene, with esters such as n-butylacetate. The polybutenes are insoluble at room temperature in such polar solvents as water, ethyl alcohol, isopropyl alcohol, acetone, methylethyl ketone and glacial acetic acid, but are partially soluble in n-butyl alcohol. The polybutenes are made by polymerizing an isobutylene-rich butene stream with a metal halide catalyst. The polymer backbone structure resembles polyisobutene, although more 1-and 2-butenes are incorporated in the lower molecular-weight fractions.

The polybutenes comprises 90–99% of the composition and have the following formula:

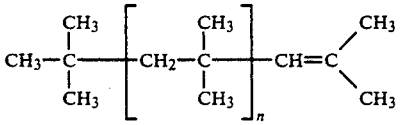

wherein n is from about 2 to 40. The preferable value of n is from about 5 to 10.

The average molecular weight of the material is thus between about 250 and 500, preferably in the range of about 330.

The properties of these polybutenes are as follows:

TABLE 1

| Properties | Test Method | Value |
|---|---|---|
| Viscosity | D445 | |
| cSt at 38° C. (100° F.) | | 27–33 |
| cSt at 99° C. (210° F.) | | — |
| Flash Point COC C(°F.), Min. | D92 | 138 (280) |
| API Gravity at 16° C. (60° F.) | D287 | 36–39 |
| Color | APHA | |
| Haze Free, Max. | | 70 |
| Haze, Max | | 15 |
| Appearance | Visual | No Foreign Material |
| Odor | | Pass |
| Viscosity, SUS at 38° C. (100 F.) | — | 139 |

TABLE 1-continued

| Properties | Test Method | Value |
|---|---|---|
| SUS at 99° C. (210 F.) | | 42 |
| Average Molecular Weight | Vapor Phase Osmometer | 320 |
| Viscosity Index | ASTM D567 | 69 |
| Fire Point COC, °C. (°F.) | ASTM D92 | 154 (310) |
| Pour Point, °C. (°F.) | ASTM D97 | −51 (−60) |
| Specific Gravity 15.6/15.6° C. (60/60° F.) | — | 0.8373 |
| Density. Lb/Gal | — | 6.97 |
| Ref. Index, $N_{20}D$ | ASTM D1218 | 1.4680 |
| Acidity, mg KOH/g | ASTM D974 | 0.03 |
| Total sulfur, ppm | X-Ray | 6 |
| Appearance | Bright and clear; free from suspended matter | |
| Evaporation Loss 10 Hours at 210° F. (WT %) | ASTM D972 | 12.1 |

A gelling agent of the invention is a hydrophobic silicon produced from organosilanes by replacing OH groups with CH. Silicon Dioxide particulates of small size do not have abrasive characteristics. The preferred size particle for this invention ranges from 12 to 16 millimicrons. The fumed silica is a readily available material commercial product of Degussa Corporation and is marked under the trade name "Aerosil R972". The amount of Aerosil R972 incorporated in the composition is from about 1% to about 10%. The properties of Aerosil R972 are shown in the following table:

TABLE 2

| Property | Value |
|---|---|
| Appearance | white powder |
| BET surface area ($m^2/g$) | 110 + 20 |
| Average primary particle size (nanometer) | 16 |
| Tamped density (g/l) | |
| Standard material | appr. 50 |
| Densed material (add >>V<<) | appr. 90 |
| Moisture when leaving plant site (2 hours at 105° C.) (%) | <0.5 |
| Ignition loss (2 hours at 1000° C.) (%) | <2 |
| pH (in 4% aqueous dispersion) | 3.6–4.3[10] |
| $SiO_2$ (ignited for 2 hours at 1000° C.) (%) | >99.8 |
| $Al_2O_3$ (ignited for 2 hours at 1000° C.) (%) | <0.05 |
| $Fe_2O_3$ (ignited for 2 hours at 1000° C.) (%) | <0.01 |
| $TiO_2$ (ignited for 2 hours at 1000° C.) (%) | <0.03 |
| HCl (ignited for 2 Hours at 1000° C.) (%) | <0.05 |

The oily polybutene sold by Chevron Chemical Company under designation grade 32E may be employed in accordance with the present invention, in amounts of about 1% based upon the total weight, is an inert oil of moderate to high viscosity and tackiness. The polybutene has the formula:

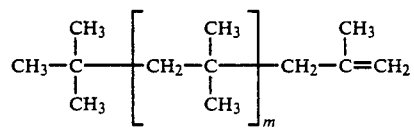

where n is from 15 to 35, preferably from about 20 to 25. The average molecular weight of the material is thus between about 1,000 and 2,000, preferably in the range of about 1,500.

The additive which may be employed in this invention comprises an amine phosphate such as Irgalube 349 readily available from CIBA-GEIGY Corporation. The properties of Irgalube 349 are shown in the following table:

TABLE 3

| Chemical Description<br>Property | An amine phosphate<br>Value |
|---|---|
| Appearance | Yellow viscous liquid |
| Density at 20° C. | 0.91 g/cm (7.6 lb/gal) |
| Pour point | −24° C. |
| Viscosity | 8750 $mm^2/s$ (cSt) at 25° C.<br>2323 $mm^2/s$ (cSt) at 40° C.<br>76 $mm^2/s$ (cSt) at 100° C. |
| Flash point | 97° C. |
| Acid number | 130 mg KOH/g |
| Phosphorus content wt % | 4.9 |
| Nitrogen content wt % | 2.7 |
| Refractive index | 1.46 ($n_D^{20}$) |
| Solubility | |
| Mineral Oil | Soluble |
| Water | Insoluble |

Any polymeric fluorocarbon powder can be used in this invention provided it is characterized by a high melting point, i.e., above 450° F., and consists of finely divided particles whose average size ranges from submicron (e.g. about 0.1 micron) to 100-micron size. Preferably, these particles will have an average particle size of about 0.7 micron. Preferred are the polymeric fluorocarbons selected from the group consisting of polytetrafluoroethylene (TFE) and fluorinated ethylene propylene (FEP) copolymer. The polymeric fluorocarbon compounds operable in this invention may be produced as readily available commercial commodities under trade names such as "TFE Teflon" and "FEP Teflon". The polytetrafluoroethylene is a polymer of a fully fluorinated hydrocarbon of the basic chemical formula ($—CF_2—CF_2—$) containing 71% by weight of fluorinated ethylene. The propylene copolymer is a fully fluorinated resin prepared by polymerization of tetrafluoroethylene and hexafluoropropylene to form a copolymer containing about 5 to about 50 weight percent hexafluoropropylene and about 95 to about 50 weight percent tetrafluoroethylene. These copolymers have respective melting points ranging from about 480° F. to about 560° F. Especially preferred for use in this invention is polytetraflouroethylene (PTFE).

It is also within the contemplation of this invention to include small amounts of other compositions so as to complement or further increase the lubricating compositions desired characteristics. Contemplated compositions include dyes, antitoxidants, cationic surfactants, rust inhibitors, emulsifiersd, atapulgite gelling agents, imidozoline oleate, zeolites and styrene butadiene, mineral oil such as paraffinic mineral oil.

The compositions set forth below are illustrative of the various embodiments of lubricating compositions falling within the present invention:

| | |
|---|---|
| Example 1 | |
| Polybutene Grade L14 | 95% |
| Hydrophobic fume silica | 5% |
| | 100% |
| Example 2 | |
| Polybutene Grade L14 | 93.6% |
| Fumed Silica Aerosil R972 | 4.3% |
| Polybutene Grade 32 E | 1.1% |
| Irgalube 349 | 0.5% |
| Polyglycol P2025 | 0.5% |
| (polyethylene glycol) | |
| | 100% |
| Example 3 | |
| Polybutene Grade L14 | 90% |
| Hydrophobic Fumed Silica | 5% |
| Polybutene Grade 32 | 1% |
| PTFE | 3% |
| Irgalube 349 | 0.5% |
| Polyethylene Glycol | 0.5% |
| | 100% |
| Color Polychrome Orange | (Trace to Sample) |

The aforesaid compositions may be formed by special blending method disclosed below. The base fluid and any fluid additives, such as anti-oxidents and pumped or otherwise delivered into a dissolver and if required, a vacuum may be employed. The dissolver is a high-speed blender which has either stationary or movable wiper blades arranged to fold product into a vortex in order to produce a spiral mixing with high shearing action. The dissolver is run at high speed (approximately 1200–1600 rpm). The speed of mixing is directly proportional to the viscosity of the material, which can range from 400,000 to 1,600,000 centistokes. This procedure is a high shear force operation, whereby the ingredients are mixed under forces and stresses of sufficient intensity to yield a thoroughly homogenized product. If the product contains polytetrafluorothylene, it is added at this time. The mixing continues and is periodically inspected to be certain that all components are being thoroughly blended. The blades are positioned so that mixing takes place uniformly. In order to accomplish this, the blades may be moved vertically to cause a maximum vortex and high shearing force throughout the mixture to insure complete homogeneity.

The mixing should continue until the temperature reaches a level at which complete melting of the product occurs, along with removal of entrapped gas and moisture. The temperature can range from 260 to 320 F., depending upon the viscosity of the material. Once optimum temperature is reached, the speed is reduced to approximately 600–900 rpm, depending upon the material. The temperature is held for a period of approximately 30 minutes, depending upon the viscosity of the material, in order to degas the mixture. A gelling agent, such as hydrophobic fumed silica is gradually added to the mixture by static transfer, in order to avoid the absorbtion of gas or moisture by the mixture.

Mixing will continue to insure homogeneity, under high shear force, which is maintained by raising or lowering the blades of the mixer. The product is then left to cool in a manner to insure that neither gas nor moisture will contaminate it. The product is ready for shipment by withdrawing it from the chamber by means of a transfer pump at low pressure. It is then introduced into the shipping containers by a bottom filling method in which the filling tube is kept immediately beneath the surface of the material, as is is being introduced into the container.

The compositions formed in accordance with the present invention are trixotropic and are operable over an extremely wide temperature range, i.e., from about −75 F. to +650 F. They are water resistant, remain soft at both ends of the temperature spectrum, and afford zero attenuation. Some of the compounds are compatible with sea water immersion, fresh water immersion, alkali immersion to pH 13, and to mild acid immersion for short durations. They are compatible with a variety of jacket materials, including polypropylene, polyethylene, and polycarbonate materials.

To employ the compositions of the present invention, they are generally introduced into the extrusion die head which also carries the optical fiber elements and the molten polymer which is used to form the jacket. By employment in this way, the composition encases the optical fiber elements and flood the inner portion of the jacket with dielectric material. The composition thus reduces movement of the optical fiber elements within the jacket, so as to control any attenuation to less than 4 dB/km, an industry requirement. It also creates a moisture barrier and discourages moisture accumulation within the jacket.

If moisture accumulation is not prevented, the moisture may attack the acrylate cladding which is generally formed on the optical fiber elements, causing signal distortion and attenuation. Thus, the water-proofing properties of the composition of the present invention are essential to the integrity of the overall optical fiber construction and to signal stability.

Particularly when more than one optical fiber element is included in the overall cable construction, the compositions of the present invention act as lubricants. Thus, the compositions cushion and reduce the amplitude of movement within the jacket of the multi-filament construction.

The compositions of the present invention meet the specifications listed below:

| Property (Test Method) Specifications: | Value |
|---|---|
| Operating temperature | (−60° C. to 345° C.) −75° F. to 650° F. |
| Viscosity - (Penetrometer) | From 275 + 10 to 330 + 10 |
| Dropping Point (°F. ASTM D-566 in Heat Chamber) | No melt |
| Color | White Translucent to Olive Green |
| Texture | Smooth - Buttery |
| Odor | None |
| pH (Base Fluid) | 7.5 |
| Rust test (Inhibited - rust and corrosion) ASTM D-1743 | Pass |
| Oxidation (Inhibited) (ASTM D-942) | 0 |
| Water Resistance (ASTM D-1264) | 100% water resistant |
| Effect on Copper (ASTM D-1261) | 0 |
| Effect on Fiber coatings (Corning Test) | 0 |
| Oil Separation (ASTM D-1742 & FIM-781-B) | Less than 1/10 of 1% |
| D.C. Resistivity at 25° C. Ohm-cm | $1700 \times 10^{12}$ |
| Insulation Resistance (ohm-cm at 100 volts) | $1\text{-}2 \times 10^{14}$ |
| Dielectric constant at 1 mH | 2.10 |
| Compound life (encapsulated) | Undetermined - over 10 years |
| Evaporation Loss, wgt % (22 hrs. at 149° C.) (300° F.) | Less than 0.3% |
| Gamma radiation | $2 \times 10^8$ RAD |
| Dissipation Factor at ambient °F. | .00064 |
| Density/gallon | 8.725 |
| Dielectric dissipation factor of P.T.F.E. at $10^6$ | 2.0–2.1 |
| Polyethylene stress cracking test MS-17000 sec. 1078 | Pass |
| Air entrapment | None |
| Pumpability | 100% |
| Dry Heat Aging | 0 |
| Slump | 0 |
| Non Toxic | |

While certain representative embodiments and details have been shown for the purpose of illustrating the invention, it will be apparent to those skilled in this art that various changes and modifications may be made therein without departing from the spirit or scope of the invention.

What is claimed is:

1. A fiber optic cable comprising a protective jacket carrying a fiber optic element therein and a lubricating composition filling the space around said fiber optic element within said protective jacket, said lubricating composition comprising a stable dispersion of:

a. a polybutene having the formula:

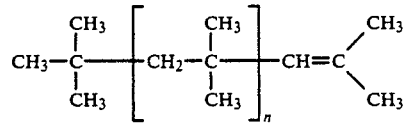

where n is from about 2 to 40, said polybutene having average molecular weight in the range of from about 300 to about 350 and comprising about 90% to about 99% by weight of said composition;

b. a silicon dioxide in the form of finely divided hydrophobic silica powder with particles ranging from about 12 to about 16 millimicrons in size, said silicon dioxide comprising from about 2% to about 10% of said composition;

c. an oily polybutene having the formula:

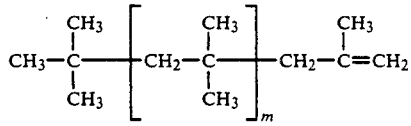

wherein m is from about 15 to about 35, said polybutene having average molecular weight in the range of from about 1000 to 2000 and comprising from about 0% to about 10% by weight of said composition; and d. a amine phosphate comprising from about 0% to about 1% by weight of said composition.

2. A fiber optic cable comprising a protective jacket carrying a fiber optic element therein and a lubricating composition filling the space around said fiber optic element within said protective jacket, said lubricating composition comprising a stable dispersion of:

a. a polybutene having the formula:

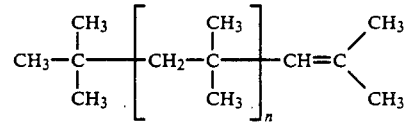

where n is from about 2 to about 40, said polybutene having average molecular weight in the range of from about 300 to about 350 and comprising about 90% to about 99% by weight of said composition;

b. a silicon dioxide in the form of finely divided hydrophobic silica powder with particles ranging from about 12 to about 16 millimicrons in size, said silicon dioxide comprising from about 2% to about 10% of said composition;

c. an oily polybutene having the formula:

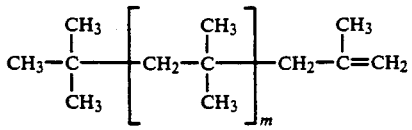

wherein m is from about 15 to about 35, said polybutene having average molecular weight in the range of from about 1000 to about 2000 and comprising from about 0% to about 10% by weight of said composition;

d. an amine phosphate comprising from about 0% to about 1% by weight of said composition; and e. a finely divided, polymeric, fluorocarbon powder comprising polytetrafluoroethylene in the form of particles ranging from 0.1 to 100 microns in size and havig a melting temperature at least 450 F., said polymeric fluorocarbon powder comprising up to about 3% of said composition.

3. A fiber optic cable comprising a protective jacket carrying a fiber optic element therein and a lubricating composition filling the space around said fiber optic element within said protective jacket, said lubricating composition comprising a stable dispersion of:

a. about 93.6 parts by weight of a polybutene having the formula:

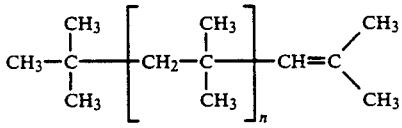

where n is from about 2 to 40, said polybutene having average molecular weight in the range of from about 300 to about 350 and comprising from about 90% to about 99% by weight of said composition;

b. about 4.3 parts by weight of a silicon dioxide in the form of finely divided hydrophobic silica powder with particles ranging from about 12 to about 16 millimicrons in size;

c. about 1.1 to parts by weight of an oily polybutene having the formula:

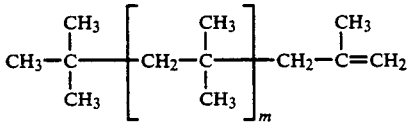

wherein m is from about 15 to about 35, said polybutene having average molecular weight in the range of from about 1000 to about 2000;

d. about 0.5 part by weight of an amine phosphate; and e. about 0.5 part by weight of a polyethylene glycol.

4. A fiber optic cable comprising a protective jacket carrying a fiber optic element therein and a lubricating composition filling the space around said fiber optic element within said protective jacket, said lubricating composition consisting essentially of a stable dispersion of:

a. finely divided silica powder comprising particles ranging from about 7 to 40 millimicrons in size, said silica powder comprising from about 2 to about 10 percent by weight of the said composition;

b. an oily polybutene having the formula:

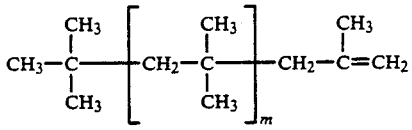

where m is a whole number in the range of about 15 to about 35, said polybutene having a mean molecular weight ranging between from about 1000 to about 2000, said polybutenes comprising about 1 percent by weight of said composition; and c. lubricating liquid making up the balance of said composition.

5. A fiber optic cable comprising a protective jacket carrying a fiber optic element therein and a lubricating composition filling the space around said fiber optic element within said protective jacket, said lubricating composition consisting essentially of a stable dispersion of:

a. finely divided silica powder comprising particles ranging from about 7 to 40 millimicrons in size, said silica powder comprising from about 2 to about 10 percent by weight of said composition;

b. finely divided polytetrafluoroethylene comprising particles ranging from about 0.1 to 100 microns in size and having a melting temperature about 450 F., said polytetrafluoroethylene comprising up to about 3 percent by weight of said composition;

c. an oily polybutene having the formula:

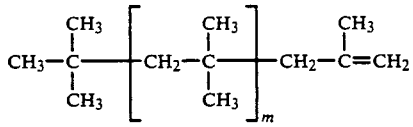

where m is a whole number in the range of about 15 to about 35, said polybutene having a mean molecular weight ranging between from about 1000 to about 2000, said polybutene comprising about 1 weight percent of said composition;

d. a lubricating liquid making the balance of said composition.

6. A method of fabricating a fiber optic cable comprising in an extrusion die:

a. placing into said extrusion die a first protective tube;

b. inserting an optical fiber into said first protective tube;

c. surrounding said first protective tube with a second protective tube;

d. introducing a thixotropic composition into said first protective tube between said first protective tube and said optical fiber to surround said optical fiber and into the space between said first protective tube and said second protective tube; and e. extruding a fiber optic cable from said extrusion die.

7. A method of fabricating a fiber optic cable comprising in an extrusion die:

a. placing into said extrusion die a plurality of first protective tubes each of which has an optical fiber therein;

b. surrounding said first protective tube with a second protective tube;

c. introducing a thixotropic composition into said first protective tube to cover each optical fiber to maintain the optical characteristics thereof; and d. extruding said fiber optic cable from said extrusion die.

8. A method of fabricating a fiber cable comprising in an extrusion die:

a. placing into said extrusion die a first protective tube;

b. inserting an optical fiber into said first protective tube;

c. surrounding said first protective tube with a second protective tube;

d. introducing a thixotropic composition into the space between the first protective tube and the second protective tube; and e. extruding a fiber optic cable from said extrusion die.

9. The method of claim 6 wherein said thixotropic composition is the lubricating composition set out in claim 1.

10. The method of claim 7 wherein said thixotropic composition is the lubricating composition set out in claim 2.

* * * * *